US007891186B1

(12) United States Patent
Primlani

(10) Patent No.: US 7,891,186 B1
(45) Date of Patent: Feb. 22, 2011

(54) SYSTEM AND METHOD OF WASTE HEAT RECOVERY AND UTILIZATION

(76) Inventor: Indru J. Primlani, 201 Union Ave. Southeast, #186, Renton, WA (US) 98059

( * ) Notice: Subject to any disclaimer, the term of this patent is extended or adjusted under 35 U.S.C. 154(b) by 0 days.

(21) Appl. No.: 12/685,997

(22) Filed: Jan. 12, 2010

(51) Int. Cl.
*F01K 3/00* (2006.01)
*F01K 23/06* (2006.01)
*F01K 23/14* (2006.01)
*F01K 7/34* (2006.01)

(52) U.S. Cl. ..... 60/618; 60/597; 60/604; 60/670; 60/653

(58) Field of Classification Search ..... 123/604, 123/616, 618, 597, 517–518, 641.1, 641.7, 123/641.8, 641.14, 563, 653, 670, 671, 679, 123/39.183, 772–775, 525, 682–684; 180/7.4, 180/165; 62/643
See application file for complete search history.

(56) References Cited

U.S. PATENT DOCUMENTS 3,141,293 A * 7/1964 Crooks ..... 60/604
3,950,949 A * 4/1976 Martin et al. ..... 60/641.8
3,995,431 A * 12/1976 Schwartzman ..... 60/684
4,003,344 A 1/1977 Bradley ..... 60/618
4,327,808 A * 5/1982 Howard ..... 180/7.4
4,334,409 A 6/1982 Daugas ..... 60/618
4,393,656 A 7/1983 Anderson et al. ..... 60/618
4,417,446 A * 11/1983 Nakamoto et al. ..... 60/641.7
4,745,749 A * 5/1988 Benson ..... 60/518
4,873,840 A 10/1989 Gilliusson ..... 62/238.6
4,996,845 A 3/1991 Kim ..... 60/618
5,228,293 A * 7/1993 Vitale ..... 60/641.14
5,339,632 A * 8/1994 McCrabb et al. ..... 60/618
5,351,487 A * 10/1994 Abdelmalek ..... 60/618
5,456,076 A * 10/1995 Zornes ..... 60/525
5,860,279 A * 1/1999 Bronicki et al. ..... 60/670
6,000,211 A 12/1999 Bellac et al. ..... 60/39.05
6,397,596 B1 * 6/2002 Boyle ..... 60/597
6,484,501 B1 * 11/2002 Mieth et al. ..... 60/618
6,513,328 B2 * 2/2003 Baeuerle et al. ..... 60/604
6,948,315 B2 * 9/2005 Kirby et al. ..... 60/653
7,134,285 B2 11/2006 Primlani ..... 60/784

(Continued)

FOREIGN PATENT DOCUMENTS

DE 19546301 A1 * 6/1997

(Continued)

*Primary Examiner*—Thai Ba Trieu
(74) *Attorney, Agent, or Firm*—Seed IP Law Group PLLC

(57) ABSTRACT

A waste heat recovery system is provided for an internal combustion engine having a piston, a cylinder and an intake manifold, significantly improving gas mileage efficiency without reliance on alternative fuels. The system includes a heat loop having a heat transfer fluid, a compressor in fluid communication with the intake manifold to supply compressed air thereto, a Stirling engine operated and optimized via thermal communication with the heat loop, and operatively coupled to the compressor. The system includes a chiller in thermal communication with the heat loop, and with the intake manifold to cool the compressed air communicate to the cylinder. The system may include additional Stirling engines operating other devices, or being operated by a device, such as a propeller. A vehicle can incorporate the system and route fluid to and from a radiator. The system can be used in both portable and stationary applications.

21 Claims, 4 Drawing Sheets

U.S. PATENT DOCUMENTS

| | | | | |
|---|---|---|---|---|
| 7,152,407 | B2 * | 12/2006 | Jobson | 60/604 |
| 7,181,912 | B2 * | 2/2007 | Mori | 60/517 |
| 7,654,073 | B2 * | 2/2010 | Primlani | 60/39.183 |
| 2004/0255586 | A1 * | 12/2004 | Hamada et al. | 60/670 |
| 2007/0289721 | A1 * | 12/2007 | Miyagawa et al. | 165/104.21 |
| 2008/0092590 | A1 * | 4/2008 | Yearout | 62/643 |
| 2009/0031999 | A1 * | 2/2009 | Erickson | 123/563 |
| 2010/0077746 | A1 * | 4/2010 | Gray, Jr. | 60/604 |

FOREIGN PATENT DOCUMENTS

| | | | |
|---|---|---|---|
| JP | 56101045 | A * | 8/1981 |

* cited by examiner

SYSTEM AND METHOD OF WASTE HEAT RECOVERY AND UTILIZATION

BACKGROUND

1. Technical Field

The present application is generally related to improvements in internal combustion engines, and particularly, to a waste heat recovery system and method for internal combustion engines that use pistons.

2. Description of the Related Art

Improvements in vehicle operation efficiencies revolve around a number of parameters, including environmental impact, performance, and fuel type. Recent developments have primarily been made in the field of hybrid fuel technology, in an effort to improve vehicle fuel efficiency and reduce pollution generation from operation of the vehicle. Hybrid or alternative fuel vehicles typically rely on electrical, or fuel-cell technology. Hybrid fossil fuel-electric vehicles, however, have thus far only reached limited improvements in fuel consumption efficiency. Furthermore, hybrids and fuel-cell vehicles require high capital costs. Moreover, fuel-cell technology is not yet developed to a point to be sufficiently efficient for the current consumer market, and lacks efficient large-scale fueling station planning.

In addition, non-combustion motors have been proposed to be powered by waste heat to power accessories such as generators, and climate control. However, this utilization of waste heat has not had a significant impact in reducing the environmental impact of internal combustion engines, and use of waste heat has generally not been proposed, and has been deemed impractical, to aid operation of the piston engines.

BRIEF SUMMARY

The present disclosure provides a system and method that facilitates recovering waste heat generated in an engine, such as an internal combustion engine, to improve the fuel consumption efficiency of the engine, and improve other operating conditions of the engine. Some embodiments increase the thermal efficiency of the engine, which when incorporated on a large scale on numerous engines in portable and/or stationary applications, can significantly contribute to reducing global warming and reducing air pollution emissions.

Some embodiments result in the engine producing higher torque than existing engines at lower revolutions per minute, prolonging the life of the engine and lubricants therein, and extending combustion duration in the power stroke. Therefore, fuel is more completely consumed and the power output is increased as compared to existing engines. Lower engine speeds also reduce engine noise, contributing to a significant reduction in noise pollution. Furthermore, engine component life is prolonged due to extraction of waste heat from the engine resulting in a cooler engine compartment.

In some embodiments, the present system can obviate, or minimize the size of, an engine radiator, facilitating a smaller engine compartment and/or a more aerodynamic front end of a vehicle.

Some embodiments include one or more propellers powered by the present system or being powered by ram air to introduce more heat into the system, the resulting energy being used to regulate or aid propulsion or drag.

According to one embodiment, a waste heat recovery system configured to be used with an internal combustion engine having at least one piston and at least one cylinder in fluid communication with an intake manifold, includes a heat loop configured to transport a heat transfer fluid and to be in thermal communication with at least a portion of the internal combustion engine to receive waste heat therefrom and increase the temperature of the heat transfer fluid. The system further includes a compressor configured to be in fluid communication with the intake manifold of the internal combustion engine to supply compressed air thereto, and at least a first non-combustion engine in thermal communication with the heat loop and powered by the waste heat transferred by the heat transfer fluid. The first non-combustion engine is operatively coupled to the compressor to operate the compressor. The system also has a cooling device directly or indirectly operated by the waste heat transferred by the heat transfer fluid in the heat loop, the cooling device configured to be in thermal communication with the intake manifold of the internal combustion engine to cool the compressed air and communicate the cooled compressed air to the cylinder of the internal combustion engine.

In one aspect, the cooling device is operated via the first non-combustion engine or via a second non-combustion engine in thermal communication with the heat loop.

In one aspect, the system includes a cold fluid tank in thermal communication with the cooling device, the first non-combustion engine including a first Stirling engine having hot and cold sinks, the cold fluid tank configured to be in thermal communication with the cold sink of the first Stirling engine.

In some embodiments, the system includes a second non-combustion engine in thermal communication with the heat loop, and operatively coupled to a first propeller to operate the first propeller, the first propeller generating a propulsive force when rotated. In other embodiments the first propeller can be operated by the first non-combustion engine.

In one aspect, the system has a cold fluid tank in thermal communication with the cooling device, the cooling device configured to be in thermal communication with the intake manifold of the internal combustion engine via the cold fluid tank.

Some embodiments include a third non-combustion engine in thermal communication with the heat loop, and a second propeller operatively coupled to the third non-combustion engine to operate the third non-combustion engine when activated, the third non-combustion engine further increasing the temperature of the heat transfer fluid when operated. In one aspect, such a system may include a gate member configured to transform between an open state and a closed state, wherein the second propeller is configured to be activated when exposed to ram air, the gate member allowing ram air to reach the propeller when in the open state and preventing ram air from reaching the second propeller when in the closed state.

In some embodiments, the system may include a cold fluid tank configured to maintain a vacuum and in thermal communication with the intake manifold of the internal combustion engine, a double-acting piston assembly operatively coupled to, and driven by, the first non-combustion engine, and operable to expand a fluid below atmospheric pressure and communicate expanded cool fluid, and a sparger in fluid communication with the double-acting piston assembly to receive the expanded cool fluid therefrom, the sparger being in at least one of fluid and thermal communication with the cold fluid tank to cool a fluid therein.

In another embodiment a vehicle is provided, which can include an engine and a waste heat recovery system according to any one or more of the foregoing embodiments and aspects. In some embodiments, the vehicle can further have a radiator in fluid communication with the first non-combustion engine and/or the cold fluid tank discussed above.

Some embodiments may include a temperature sensor and a heat transfer fluid valve installed on a line that routes fluid between the radiator and the engine, the valve being operable to transfer fluid to the heat loop. In one aspect, an electronic control unit is included in electronic communication with the temperature sensor, and configured to receive temperature information of the fluid from the temperature sensor, the electronic control unit configured to control a heat transfer fluid valve to open the valve and communicate fluid from the fluid line to the heat loop to be used as the heat transfer fluid when a temperature information equal to, or past, a threshold temperature is communicated from the temperature sensor to the electronic control unit.

DETAILED DESCRIPTION

Figure 1:
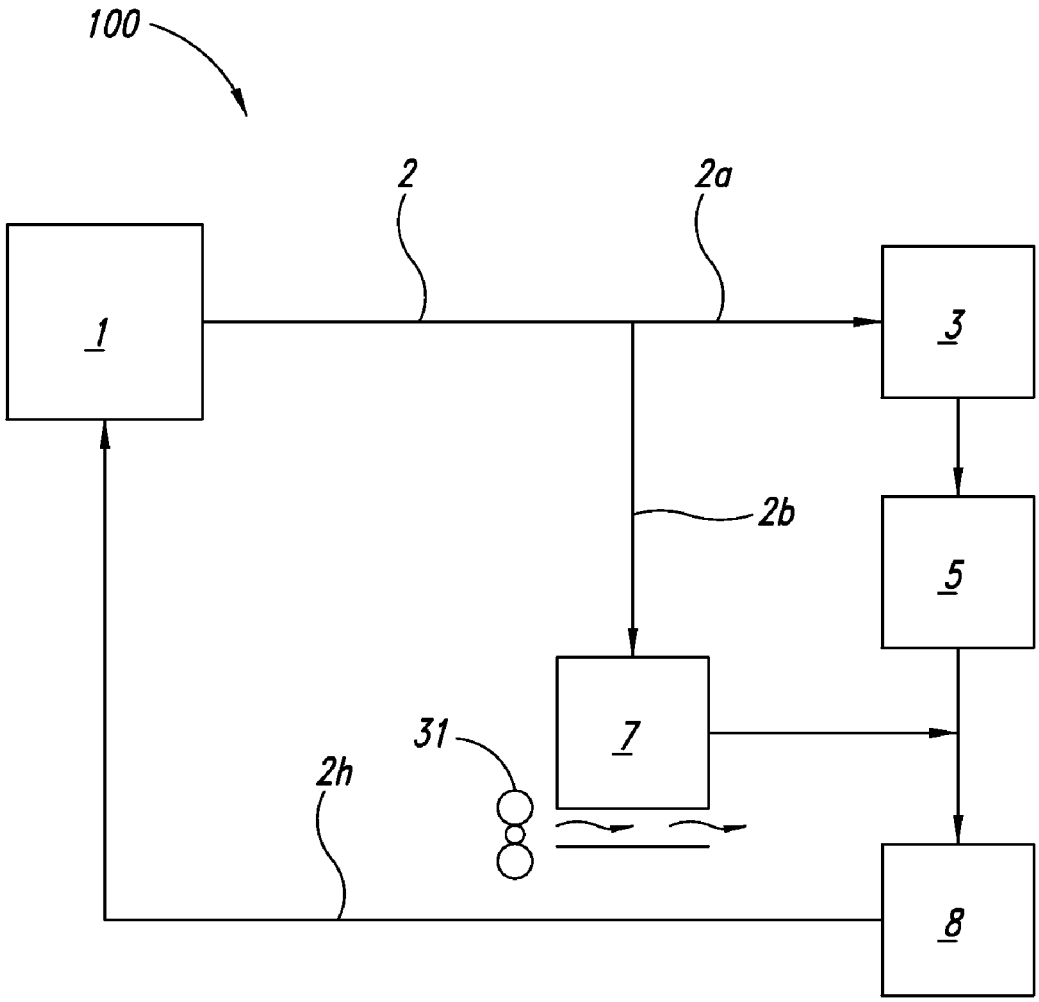
FIG. 1 is a schematic diagram of a waste heat recovery and utilization system according to one embodiment.

FIG. 1 illustrates a waste heat recovery and utilization system 100 according to one embodiment. The system 100 includes an internal combustion engine 1, a non-combustion engine 3, a compressor 5, and a cooling system or apparatus 7. In one aspect, the non-combustion engine 3 can include a Stirling engine, and the cooling system 7 can include a chiller. For clarity of description and convenience, reference to non-combustion engines will hereinafter be made by "Stirling engine," without any intention to limit the present disclosure or to exclude other suitable non-combustion engines. Similarly, reference to cooling systems or apparatuses will hereinafter be made by "chiller," without any intention to limit the present disclosure or to exclude other suitable cooling devices.

In one aspect, the system 100 further includes a waste heat loop 2 configured to recover heat from the engine 1 and route it to the Stirling engine 3.

The waste heat loop 2 includes a heat transfer fluid, such as water and/or additives suitable for obtaining low temperatures without freezing, which is heated by heat generated due to combustion and other sources, inside, and/or by surfaces of, the engine 1 or by engine components. The waste heat loop 2 can include a first heat line 2*a*.

The heated heat transfer fluid can be routed toward the Stirling engine 3 via the first heat line 2*a* to power the Stirling engine 3, which in turn can power the compressor 5. In one aspect, the waste heat loop 2 includes a second heat line 2*b* that routes the heat transfer fluid to the chiller 7. The chiller 7 can include an absorption chiller, such as absorption refrigeration devices, including those that use ammonia-hydrogen-water, air systems, and/or water and salt water solutions, for example a lithium bromide and water solution. In cases where ammonia gas is used in the chiller, a shield or sheave 31 can be added for leak prevention. Such a sheave or shield 31 can vent any toxic gases that may be discharged from the chiller 7 and divert them out and away from a vehicle cabin.

In one aspect the chiller 7 and/or chilled fluid discharged therefrom is in thermal communication with one or more of the compressor 5, the compressed air discharged from the compressor 5, and an intake manifold 8 of the engine 1. Accordingly, air compressed in, and being discharged from, compressor 5 is chilled at, or on its way to, the intake manifold 8 of the engine 1, which routes the chilled compressed air to an intake cylinder to be used as combustion air. The chilled compressed air has a high density and thus contains a larger mass of oxygen and working fluid, resulting in a significantly more complete fuel consumption as compared to existing internal combustion engines. The chilled compressed air further develops higher torque as compared to existing engines.

The charged intake cylinder of the engine causes the temperature to decrease and the pressure to increase above atmospheric pressure, improving volumetric efficiency. The additional power output and torque will enable engine operation at lower than current revolutions per minute (RPM), and will significantly reduce fuel consumption for an equivalent duty cycle. Fuel injected can be reduced to approach stoichiometric conditions. Lower RPM will also increase engine and lubricant life. Reduced fuel consumption will result in significantly lesser operations expenses, as well as in lower global warming gases, and other environmental impacts.

Figure 2:
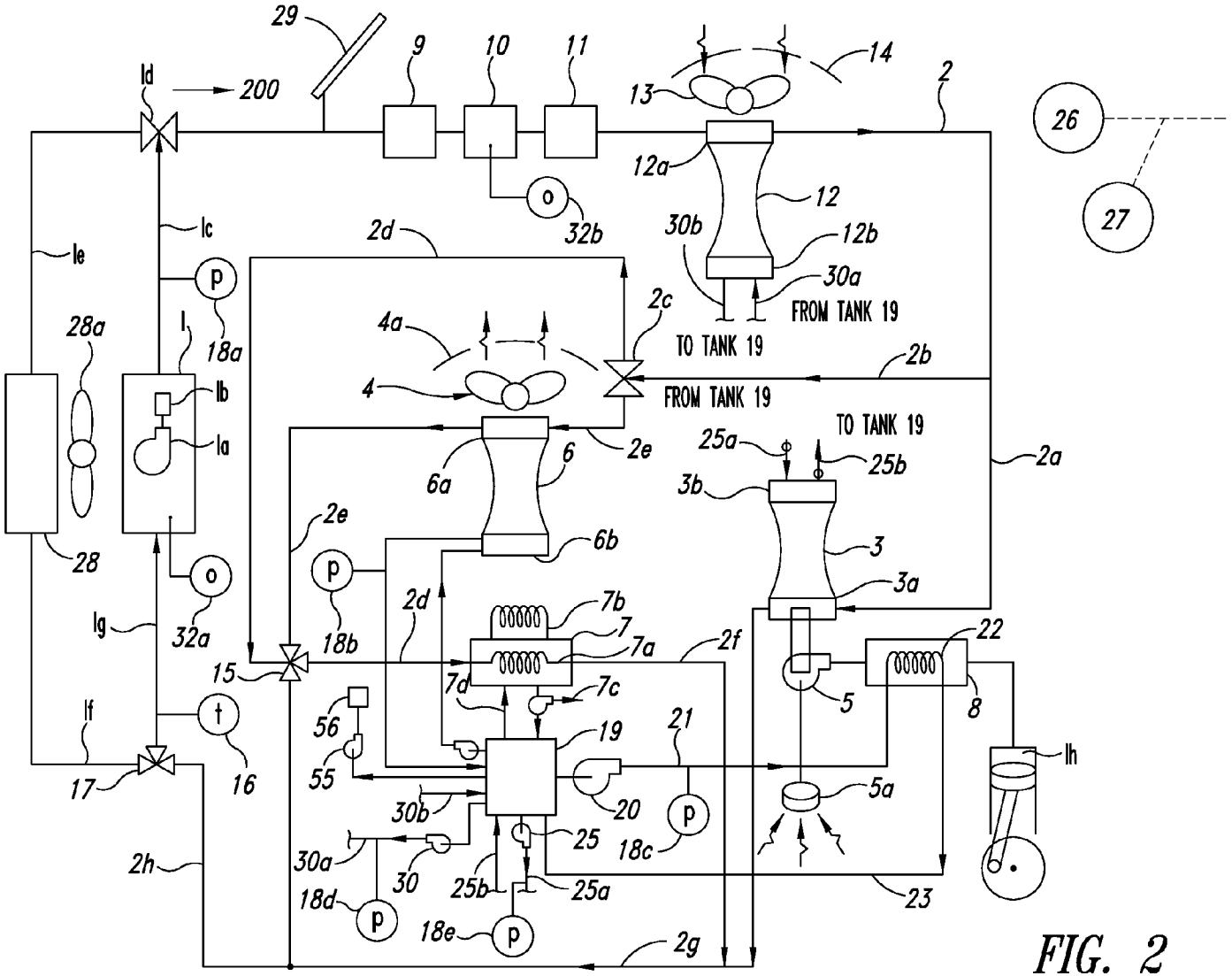
FIG. 2 is a schematic diagram of a waste heat recovery and utilization system according to one embodiment.

FIG. 2 illustrates a waste heat recovery and utilization system 200 according to another embodiment. Some of the similar components are similarly numbered for clarity of description and convenience. In one aspect, the system 200 includes an internal combustion engine 1, a waste heat loop 2, a first Stirling engine 3 operatively coupled to a compressor 5. The compressor 5 is configured to compress and communicate compressed air to an intake cylinder 1*h*, for example via manifold 8. In one aspect, the system further includes a chiller 7 configured to cool compressed air discharged from the compressor 5. The following discussion is directed to one embodiment in which waste heat is efficiently used to power the first Stirling engine 3 and the chiller 7.

In one embodiment, heat transfer fluid is routed between the engine 1 and a radiator 28. The system may include a computer 26 in electronic communication with an electronic control unit (ECU) 27 to control a first valve 1*d*. The first valve 1*d* is configured to allow the heat transfer fluid, or a portion thereof, to be routed to the waste heat loop 2.

The waste heat loop 2, in one aspect, can include heat exchange tubing or the like in series heat transfer relationship and/or contact with insulated hot surfaces 9 of the engine 1, with insulated hot surfaces of an exhaust system 10, and/or with hot surfaces of a catalytic converter 11, and/or with any other suitable heat source. In some embodiments, a solar collector 29 may be incorporated as is disclosed in U.S. Pat. No. 7,134,285. In one aspect, the computer 26 may be integrated with ECU 27. In another aspect, the computer 26 can be separate from, and feed data to, the ECU 27.

Upon picking up heat from heat generated by components of the engine 1, the heat transfer fluid is routed toward the first Stirling engine 3 via a first heat line 2*a* of the waste heat loop 2. The Stirling engine 3 includes a hot sink 3*a* and a cold sink 3*b*. Stirling engines typically operate by cyclic compression and expansion of a working fluid, such as air or other gas or gases, at different temperature levels such that there is a net conversion of heat energy to power or mechanical work. Therefore, as the temperature difference between hot and low sinks of the engine increases, more power is created.

The first Stirling engine 3 operates the compressor 5, which is configured to compress air for mixing and combustion with fuel in intake cylinder 1*h*. In one aspect, air can be routed to the compressor through an air filter 5*a*.

In one aspect, the heat transfer fluid is routed to the chiller 7 in a second heat line 2*b* of the waste heat loop 2. In one embodiment, flow rate of the heat transfer fluid is monitored by a second valve 2*c* to a third heat line 2*d* of the waste heat loop 2 before reaching the chiller 7. In some embodiments, a third valve 15 can be provided downstream of the second valve 2*c* and upstream of the chiller 7.

Figure 3:
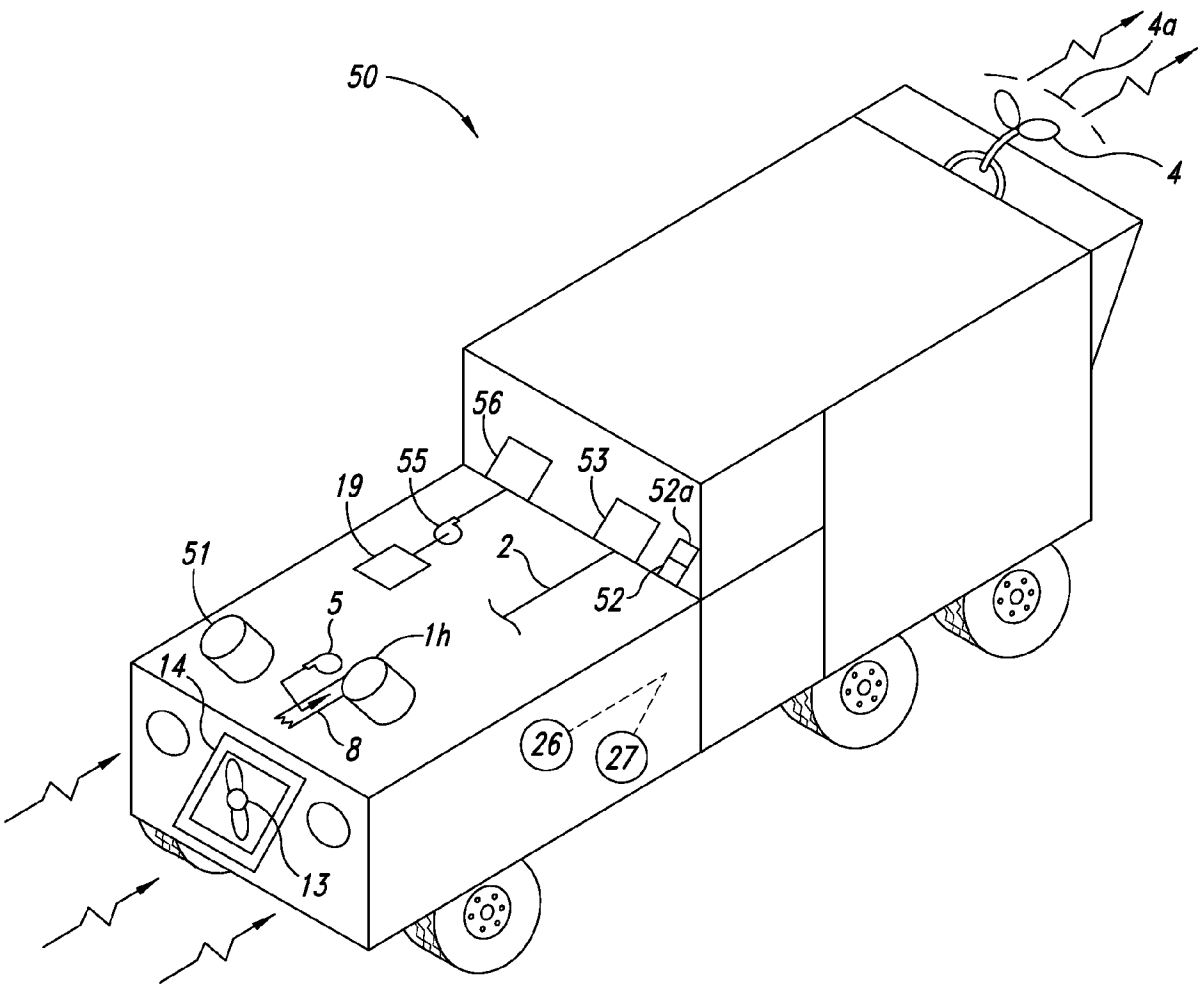
FIG. 3 is an isometric view of a vehicle incorporating a waste heat recovery and utilization system according to one embodiment.

In some embodiments, heated heat transfer fluid, for example heated water, in the second heat line 2*b* may be controlled or moderated, and sent by the second valve 2*c* to hot sink 6*a* of a second Stirling engine 6, to power a propulsion propeller 4. FIG. 3 is one illustrated embodiment in which the propulsion propeller 4 is mounted behind a screen 4*a*, for example at a rear region of a vehicle 50. The waste heat loop 2 can include a fourth heat line 2*e* to route heated heat transfer fluid from hot sink 6*a* of the second Stirling engine 6 to the chiller 7.

In the illustrated embodiment of FIG. 2, heat transfer fluid routed to the chiller 7 from hot sink 6*a* of the second Stirling engine 6 and/or directly from the second heat line 2*b* through the third heat line 2*d* and the second and third valves 2*c*, 15, can provide power to the chiller 7. In one aspect, the chiller 7 can include a heat exchanger 7*a*, and the waste heat loop 2 can include a first return line 2*f* for receiving the fluid routed through the chiller 7.

In some embodiments, the second Stirling engine 6 can be dedicated to only powering the chiller 7. In yet some embodiments, the first Stirling engine 3 can be used to power both the compressor 5 and chiller 7, the second Stirling engine 6 being used to power the propulsion propeller 4, being eliminated altogether, or being used to operate any other accessory or device.

At least a portion of the fluid in the first return line 2*f* can be routed back to the engine 1 and/or the radiator 28. In one embodiment, this return flow of the heat transfer fluid is controlled along at least one line, for example along second and third return lines 2*g*, 2*h*, and a fourth valve 17. In one embodiment, the fourth valve 17 can proportion flow of the heat transfer fluid back to engine 1 through an engine return line 1*g* or to the radiator 28 through the radiator return and send line 1*f*, based on cooling temperatures of the engine 1. Flow through valve 17 can be modulated, based on demand, between the first and second return lines 2*f* and 2*g*.

In some embodiments, the apparatus 200 may include sensors configured to provide signals of the aforesaid and other parameters to computer 26 and/or ECU 7. In one embodiment, the waste heat loop temperatures may justify a smaller radiator. For example, vehicles can be provided with a more aerodynamic front end or a smaller hood when a smaller radiator is incorporated.

In an embodiment, the internal combustion engine 1 can be provided with a coolant pump 1*a* and a thermostat 1*b* to pump the heat transfer fluid, for example, a mixture of water, antifreeze and/or automotive additives, from engine 1 via a first distribution line 1*c*, the first valve 1*d*, and a second distribution line 1*e* to radiator 28. When the temperature of the heat transfer fluid reaches a preset value, it can be returned to the engine 1 via the radiator return and send line 1*f*, valve 17 and line 1*g*.

In one embodiment, the chiller 7 uses an ammonia-hydrogen-water system and the heated heat transfer fluid flows through the heat exchanger 7*a*, which may include a coil, and evaporates liquid ammonia to provide a cooling effect. The chiller 7 can include an air cooled heat exchanger 7*b* configured to condense the ammonia gas and return the liquefied ammonia to the chiller 7.

Similar to the system 100 discussed above with respect to the illustrated embodiment of FIG. 1, the system 200 of the illustrated embodiment of FIG. 2 can in some embodiments include a sheath or shield to divert any toxic gases out and away from a cabin of a vehicle incorporating the waste heat recovery system 200.

In one embodiment, the system 200 includes a cold fluid tank 19 in fluid and/or thermal communication with the chiller 7 via a first cool line 7*d*. The chiller 7 can include a first pump 7*c*, which in cooperation with the first cool line 7*d* circulates cold fluid, such as cold water, from chiller 7 to a cold fluid tank 19.

According to one aspect, the system 200 further includes a second pump 20 configured to pump cold fluid from the cold fluid tank 19 via a second cool line 21 to cool the compressed air downstream of the compressor 5 and upstream of the intake cylinder 1*h*. For example, the system 200 may include at least one coil 22 positioned inside the intake manifold 8, in fluid communication with the second cool line 21, to cool the compressed air being fed into the intake manifold 8, and into intake cylinder 1*h* of the engine 1. In some embodiments, the second pump 20 can also be configured to return cold water to tank 19 via a cold fluid return line 23. Additional pumps, sensors, and/or valves can be provided along the second cool line 21 and/or the cold fluid return line 23, as desired or suitable for particular applications.

In some embodiments, the second cool line 21 can chill the compressed air by being in fluid and/or thermal communication with the compressor 5 and/or a line that discharges compressed air from the compressor 5.

As discussed earlier, chilled compressed air has a high density and thus contains a larger mass of oxygen resulting in more complete fuel consumption and higher torque. The charged intake cylinder of the engine causes the temperature to decrease and the pressure to increase above atmospheric pressure and improves volumetric efficiency. The additional power output and torque will enable operation at lower RPM and reduced fuel consumption. Injected fuel can be reduced to approach stoichiometric conditions. Lower RPM will increase engine and lubricant life. Reduced fuel consumption will result in lower global warming gases.

Oxygen sensors 32*a*, 32*b* can be incorporated to regulate fuel flow when the products of combustion are substantially carbon dioxide and water. In some embodiments, a catalytic converter may not be required. In some embodiments, the system may include a reducing converter to reduce the nitrogen oxides (NOx). Furthermore, in vehicles that incorporate a system according to an embodiment of the present disclosure, the performance of the vehicle will be less affected in hot areas and high altitudes. In some embodiments, when the vehicle is operating at approximately zero acceleration, propeller 4 driven by Sterling engine 6 may be used to supplement propulsion with adequate power to overcome wind and rolling resistance, further reducing fuel consumption.

Size and weight requirements for an engine incorporating a system according to an embodiment of the present disclosure, can also be reduced, as compared to prior engines. In an embodiment of the present disclosure, the mean effective cylinder pressure will also increase, producing more torque than present engines. For an equivalent power output, a stroke length of the piston can be increased with high displacement resulting in an increase in the mass of working fluid.

Additional time and turbulence and more oxygen in the air fuel mixture will result in lower CO with cooler flame temperature that will reduce the thermal NOx. Thermal NOx refers to NOx formed through high temperature oxidation of diatomic nitrogen found in combustion air. The formation rate is primarily a function of temperature and the residence time of nitrogen at that temperature. At high temperatures, for example, at or above 1600° C. (2900° F.), molecular nitrogen ($N_2$) and oxygen ($O_2$) in the combustion air disassociate into their atomic states and participate in a series of reactions. The three principal reactions (the extended Zeldovich mechanism) producing thermal NOx are:

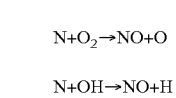

$$N_2+O \rightarrow NO+N$$

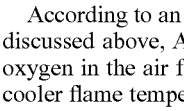

$$N+O_2 \rightarrow NO+O$$

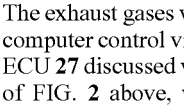

$$N+OH \rightarrow NO+H$$

According to an embodiment of the present disclosure, as discussed above, Additional time and turbulence and more oxygen in the air fuel mixture will result in lower CO with cooler flame temperature that will reduce the thermal NOx. The exhaust gases will be more completely oxidized. Precise computer control via a computer, such as computer 26 and/or ECU 27 discussed with respect to the illustrated embodiment of FIG. 2 above, will minimize combustion of fuel for a desired output.

In one embodiment, turbocharging and/or supercharging of the engine can be attained from the waste heat recovery system 200, and there are no engine power take-offs. The turbocharged and/or supercharged engine will produce more power output using more fuel and with an increase in back-pressure on the exhaust system. One advantage of an embodiment of the present disclosure with respect to efficiency is enhanced engine performance with reduced fuel consumption. Additionally, or alternatively, for top performance an advantage is available for situations, such as NASCAR, where maximum performance is designed into the system. For example, cylinder banks can be subdivided into more than one four stroke engine coupled to a single shaft containing more than one intake bank to increase net power output.

Furthermore, older vehicles can be upgraded by incorporating a system according to an embodiment of the present disclosure, for example, to meet specific fuel economy and/or performance standards. If such upgrades are deployed on a massive scale, there can be a great benefit to climate change and U.S. independence of foreign oil. For example, Diesel engines upgraded by incorporating a system according to an embodiment of the present disclosure can produce less soot and operate at lower temperatures. In some embodiments, improved fuel atomization in an additional oxygen mixture can be added to reduce air/fuel ratios with smaller and lighter power plants. Engine performance will not be affected at high altitudes and NASCAR can produce more powerful engines.

Some embodiments may include more or less components than those described without falling outside the scope of the present disclosure and the claims that follow. For example, in some embodiments, a system may exclude the propeller 4 and second Stirling engine 6. Additionally, or alternatively, in some embodiments another Stirling engine may be used as a heat pump, using heat source from the heat loop 2, to act as a compressor in regular refrigeration system, in addition, or instead, of the chiller.

In yet some embodiments, the system 200 may include a third Stirling engine 12 through which the heated heat transfer fluid passes. In one aspect, the third Stirling engine 12 is powered by a vehicle air ram effect that drives a propeller 13 during deceleration or coasting of a vehicle, such as vehicle 50 illustrated in FIG. 3. The system 200 may further include a shut-off gate 14 that is operated by an accelerator sensor 52 (FIG. 3). The shut-off screen 14 can be operated to transform from a closed to an open state under the control of the computer 26 and/or the ECU 27. The shut-off screen 14 opens during deceleration and/or coasting to permit propeller 13 to be driven by the ram effect of the onrushing air.

This turns ON or initiates operation of the third Stirling engine 12, which in some embodiments can operate as a heat pump to provide a hot sink 12*a* and a cold sink 12*b*. When the engine 1 is not decelerating or coasting, the third Stirling engine 12 can be OFF or in an inoperative state, and the heat transfer fluid passes through hot sink 12*a* without being further heated. In the illustrated embodiment of FIG. 3 the propeller 13 is shown mounted under the hood of vehicle 50; however, in other embodiments, the propeller 13 could be mounted facing the ram air in another location. Therefore, deceleration and/or coasting energy is captured and transferred, as heat, to the heat transfer fluid flowing through hot sink 12*a*.

In some embodiments, the first Stirling engine 3 can be operated by ram air similar to the operation of the third Stirling engine 12 described above, and the third Stirling engine 12 can be eliminated or be used to provide an additional source of power for any suitable use or operation of an accessory or device.

The propeller 13 can have an automatic variable pitch, and the propeller 13 and/or screen 14 can be regulated by the computer 26 and/or ECU 27, to maintain optimum temperatures. The screen 14 can be adjustable in some embodiments to facilitate minimum aerodynamic drag or positioning of the screen 14 so that it is partially open to develop additional heat in the waste heat loop 2 by loading the engine with a deliberately induced aerodynamic drag.

Such a configuration results in a more energy efficient downhill running or moving on a declined slope as compared to running on engine compression and brakes, by generating power during coasting and/or deceleration. Without the downhill compression, truck noise can be significantly reduced. Furthermore, energy regenerated according to an embodiment of the present disclosure can be the same or more than energy generated by the electrical apparatus of a hybrid vehicle. In addition, gas-electric hybrid vehicles typically lose more energy due to electrical losses than the energy lost in a pure gas dynamics of the present disclosure. This is because such vehicles necessarily have electrical losses in their system. In some embodiments of the present disclosure, during operation of the propulsion propeller 4 and/or propeller 13, the aerodynamic drag on the vehicle 50 can be regulated by adjusting the pitch of the aforesaid propellers under control of computer 26 and/or ECU 27.

When the load on engine 1 is lighter, such as during deceleration or coasting, the RPM decreases and a smaller amount of waste heat is released. In such cases, the third Stirling engine 12 can be powered by the propeller 13 as described above, and be configured to supply most or substantially all of the heat needed to power the chiller 7. When the third Stirling engine 12 is powered, its hot sink 12*a* is established and can transfer heat to the heat transfer liquid. The third valve 15 can be operated by computer 26 and/or ECU 27 to send a larger proportion of hot water through the third and/or fourth heat lines 2*d*, 2*e*, to the chiller 7, and a lesser amount of hot water back to the engine 1 via the third return line 2*h*. In some cases, substantially all of the heated heat transfer fluid in the third and/or fourth heat lines 2*d*, 2*e*, can be sent to the chiller 7, bypassing the third return line 2*h*.

Other desired variations of flow of the heat transfer fluid, and addition of other systems to achieve additional power generation, for example, to operate any desired apparatus or accessory, are contemplated to be within the scope of the present disclosure and the claims that follow. Desired flow characteristics can be achieved by programming of the computer and/or the ECU. Multiple flow options can be incorporated with control provided to an individual within a vehicle that incorporates an embodiment of the present disclosure.

In addition, in some embodiments, the system 200 may include additional lines to communicate cold fluid, such as cold water, from the cold fluid tank 19 to other locations of the system either to provide cooling or be cooled and returned to the cold fluid tank. For example, in one embodiment, as illustrated in FIG. 2, the system 200 may include a third pump 30. Referring to FIGS. 2 and 3, when the vehicle 50 is decelerating and/or coasting, cold water can be pumped from tank 19 by the third pump 30 and a third cool line 30*a* to cold sink 12*b* of the third Stirling engine 12, and returned to tank 19 via a fourth cool line 30*b*.

In some embodiments, the system 200 may include a fourth pump 25, where water is pumped by the fourth pump 25 along a fifth cool line 25*a* to cold sink 3*b* of the first Stirling engine 3 to improve its Carnot efficiency.

As previously discussed, Stirling engines typically operate by cyclic compression and expansion of a working fluid, such as air or other gas, at different temperature levels such that there is a net conversion of heat energy to power or mechanical work. Since the power generated from the net conversion of heat energy, as the temperature difference between hot and low sinks of the engine increases, more power is created. Therefore, any of the Stirling engines discussed herein or added in other embodiments can be configured to receive cold fluid from the tank 19 in order to widen the difference between the hot and low sinks thereof, and therefore, the net conversion of heat energy.

The cold water can be returned to tank 19 via a sixth cool line 25*b*. For clarity of illustrations, cool lines 25*a*, 25*b*, 30*a*, and 30*b* are shown in broken lines. Pumps 25 and 30 and/or other pumps can operate or cease operation under the control of computer 26 and/or ECU 27.

According to some embodiments, the third Stirling engine 12 and propeller 13 can automatically convert energy that would otherwise be wasted during deceleration or coasting to a useful form, namely the development of cold sink 12*b* to provide cold water to the cold sink 3*b* of the first Stirling engine 3 and/or the cold sink 6*b* of the second Stirling engine 6. This enhances the Carnot efficiency of the first and/or second Stirling engines 3 and 6. This mode is more efficient than existing gas-electric hybrid vehicles that drive generators to store electrical energy.

Therefore, the present disclosure provides an apparatus and method that provides regenerative energy by gas dynamics without miscellaneous losses in electrical systems and without the weight attributed to such systems that must be transported by the vehicle bearing them.

FIG. 3 illustrates a vehicle 50 incorporating a system according to an embodiment of the present disclosure. The hood has removed to more clearly show the various elements that in one embodiment can be positioned under the hood. During startup, even in extremely low temperatures, for example 40 degrees below zero Celsius, the compressor 5 may still be driven by an electrical system 51 until operating temperatures are reached, after which the compressor 5 can be powered by the first Stirling engine 3 as discussed above. During electrical operation, the compressor 5 can deliver compressed air to the intake manifold 8, which allows for injecting larger amounts of fuel on a molar basis, because a larger molar amount of oxygen is available to develop heat with a very rapid temperature rise in the waste heat loop 2. This enables a more expedient initial starting and heat recovery.

In some embodiments, any of the pumps shown in FIG. 2, or any other pump that may be incorporated in other embodiments, can also be configured or designed to be powered by the electrical system 51 alone, or by other electrical systems. In such embodiments, the system will enable starting the engine immediately in extremely low temperatures.

Furthermore, in some embodiments, devices can be included to route low-temperature ambient air in cold regions to cool the water in the cold fluid tank at least until the engine 1 and the waste heat recovery system 200 reach a desired operation state. Furthermore, the chiller 7 may also be operated via an auxiliary electrical system until the engine 1 and the waste heat recovery system 200 reach a desired operation state.

As illustrated in FIG. 3, in some embodiments, the system may further include an accelerometer 52*a* which produces an electrical signal representing the speed of the vehicle or the rate of change of the vehicle speed. This signal can then applied to a differentiating circuit, and the output from the differentiating circuit communicating with an indicator to convey a maximum acceleration that may be positive or negative. Moreover, in some embodiments, cabin heating may be provided by with hot heat transfer fluid, such as hot water, being sent from the heat loop 2 to a heater 53 through a cabin filter. Furthermore, cabin cooling may be provided by drawing chilled water from the cold fluid tank 19 by a fifth pump 55 and sending it to a cooling coil 56 through a cabin filter.

In some embodiments, desired pressure sensors 18*a*-18*e*, at least one temperature sensor 16 and flow sensors can be incorporated to provide operational parameters fed as electronic signals to the computer interfaced with operational engine ECU to optimize performance and energy requirements. In yet other embodiments, pressure swing adsorption systems can be incorporated and used in cases where stationary or portable systems using piston engines do not have space and/or weight limitations to further increase oxygen concentration in combustion, and attain even more reduction in carbon dioxide production.

For example, a gas mixture of air can be passed under pressure through a vessel containing an adsorbent bed that attracts nitrogen more strongly than it does oxygen. A portion or all of the nitrogen can stay in the bed, and the gas coming out of the vessel will be enriched in oxygen. When the bed reaches the end of its capacity to adsorb nitrogen, the bed can be regenerated by reducing the pressure, thereby releasing the adsorbed nitrogen. The bed is then ready for another cycle of producing oxygen enriched air that can be blended with the combustion air.

Therefore, an embodiment of the present disclosure leverages a load on an internal combustion engine to recover and utilize waste heat from the operation of engine in the form of a heat transfer fluid, such as water containing antifreeze and/or other automotive additives. The water can be heated by the heat released from the combustion of air and fuel, from the catalytic converter, from the exhaust system, and/or from supplemental heat generated as a result of operation of a heat pump, and/or any combination thereof, or any other suitable heat source. The heated fluid is transferred via a waste heat loop to a Stirling engine to power the same, which in turn powers an air compressor. In some embodiments, a dedicated heat transfer fluid can be routed through the heat loop. The Carnot efficiency of the Stirling engine operated according to an embodiment of the present disclosure, can achieve a net 400° F. high temperature and a low temperature of 10° F. This results in about 45% efficiency. In some embodiments, the efficiency could vary from 40% to 55%.

Moreover, as discussed above, the waste heat can also be fed to and power an absorption chiller to drive a cooling process that cools the compressed air for providing significantly denser and more oxygenated air to an intake cylinder for combustion with fuel.

Figure 4:
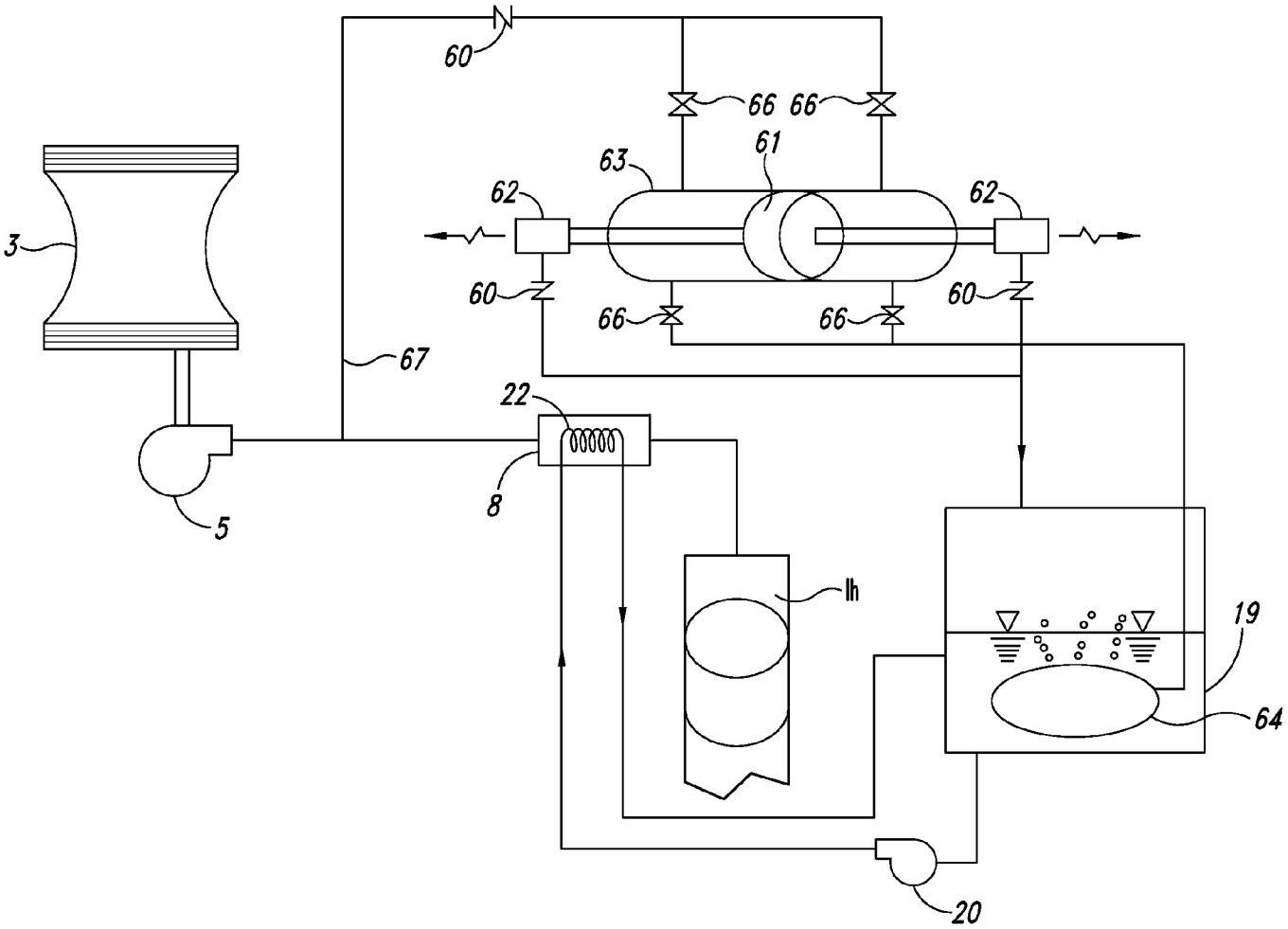
FIG. 4 is a schematic diagram of a portion of a waste heat recovery and utilization system according to one embodiment.

In some embodiments, a non-combustion engine, such as a Stirling engine, can also be used to cool the water in the cold fluid tank 19. For example, in one embodiment as shown in FIG. 4, the first Stirling engine 3 can be configured to drive the compressor 5 with pressure tap 67 to a double-acting piston 61 in cylinder 63 to drive air balancing pumps in chilled water tank 19. The double-acting piston 61 can be designed with a stroke length configured to drop pressure in cold fluid tank 19 to a vacuum of about 5 psi absolute pressure. The air is cooled by expansion and fed to a sparger 64 in tank 19. Air bubbles through the fluid, such as water, to chill it. The chilled water is transferred by a transfer pump 20 to the cooling coil 22 in the intake manifold 8. The chilled compressed air is then fed to the engine cylinder 1*h* during aspiration stroke. Check valves 60 and automatic shut off valves 66 can be incorporated to moderate the foregoing operation. Pumps 62 driven by the reciprocating or double-acting piston 61 are automatically adjusted to maintain a design vacuum in the cold fluid tank 19. In one aspect, therefore, the cold fluid tank 19 can include a vacuum tank.

Embodiments of the present disclosure can be used in portable applications such as vehicles, and in stationary applications, such as generators. Furthermore, the cooling device can include one or more of an absorption chiller operated using heat from the heat loop, and/or by heat received from solar panels, and a mechanical cooling device operated by a Stirling engine, such as any one or more of those described. The cooling device, as stated earlier, can be operated by an electrical system at engine startup, for example before the heat loop and associated components are not yet at a desired operational level. As also described earlier, devices, such as additional lines, guiding structure, and/or electronically operated valves can be provided to route cool ambient air to cool fluid in the cold fluid tank.

Accordingly, the present disclosure provides an apparatus and method of waste heat recovery that significantly improves engine efficiency without the need for electrical or other alternative fuel systems that are not yet efficiently usable, and that add significant weight and cost of maintenance to a vehicle.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A waste heat recovery system configured to be used with an internal combustion engine having at least one piston and at least one cylinder in fluid communication with an intake manifold, the system comprising:

a heat loop configured to transport a heat transfer fluid and to be in thermal communication with at least a portion of the internal combustion engine to receive waste heat therefrom and be heated thereby to increase the temperature of the heat transfer fluid;

a compressor configured to be in fluid communication with the intake manifold of the internal combustion engine to supply compressed air thereto;

at least a first Stirling engine in thermal communication with the heated heat transfer fluid in the heat loop and directly powered by the waste heat transferred thereto from the heated heat transfer fluid, and operatively coupled to the compressor to operate the compressor; and a cooling device directly or indirectly operated by the waste heat transferred thereto by the heated heat transfer fluid in the heat loop, the cooling device configured to be in thermal communication with the intake manifold of the internal combustion engine to cool the compressed air and communicate the cooled compressed air to the cylinder of the internal combustion engine.

2. The waste heat recovery system of claim 1 wherein the cooling device is operated via the first Stirling engine or a second Stirling engine in thermal communication with the heated heat transfer fluid in the heat loop.

3. The waste heat recovery system of claim 1, further comprising:

a cold fluid tank in thermal communication with the cooling device, the first Stirling engine having hot and cold sinks, the cold fluid tank configured to be in thermal communication with the cold sink of the first Stirling engine.

4. The waste heat recovery system of claim 1 wherein the cooling device includes a chiller having a heat exchanger including a coil configured to create a cooling effect by evaporating liquefied ammonia, and a sheath configured to vent gases resulting from evaporating liquefied ammonia.

5. The waste heat recovery system of claim 1, further comprising:

another Stirling engine in thermal communication with the heated heat transfer fluid in the heat loop, and operatively coupled to a propulsion propeller to operate the propulsion propeller, the propulsion propeller generating a propulsive force when rotated.

6. The waste heat recovery system of claim 1, further comprising:

a cold fluid tank in thermal communication with the cooling device, the cooling device configured to be in thermal communication with the intake manifold of the internal combustion engine via the cold fluid tank.

7. The waste heat recovery system of claim 1, further comprising:

a further Stirling engine in thermal communication with the heated heat transfer fluid in the heat loop; and an energy propeller operatively coupled to the further Stirling engine to operate the further Stirling engine when activated, the further Stirling engine further increasing the temperature of the heat transfer fluid when operated.

8. The waste heat recovery system of claim 7, further comprising:

a gate member configured to transform between an open state and a closed state, wherein the energy propeller is configured to be activated when exposed to ram air, the gate member allowing ram air to reach the energy propeller when in the open state and preventing ram air from reaching the energy propeller when in the closed state.

9. The waste heat recovery system of claim 1, further comprising:

a cold fluid tank configured to maintain a vacuum and in thermal communication with the intake manifold of the internal combustion engine;

a double-acting piston assembly operatively coupled to, and driven by, the first Stirling engine, and operable to expand a fluid below atmospheric pressure and communicate expanded cool fluid; and a sparger in fluid communication with the double-acting piston assembly to receive the expanded cool fluid therefrom, the sparger being in at least one of fluid and thermal communication with the cold fluid tank to cool a fluid therein.

10. A vehicle comprising:

an internal combustion engine having an intake manifold and at least one cylinder in fluid communication with the intake manifold;

a heat loop configured to transport a heat transfer fluid and to be in thermal communication with waste heat generated from operation of the vehicle and be heated thereby to increase the temperature of the heat transfer fluid;

a compressor configured to be in fluid communication with the intake manifold to supply compressed air thereto;

at least a first Stirling engine in thermal communication with the heated heat transfer fluid in the heat loop and directly powered by the heat transferred thereto from the heated heat transfer fluid, the first Stirling engine operatively coupled to the compressor to operate the compressor; and a cooling device directly or indirectly operated by the waste heat transferred thereto by the heated heat transfer fluid in the heat loop, the cooling device configured to be in thermal communication with the intake manifold to cool the compressed air, the cylinder receiving the cooled compressed air from the intake manifold during operation.

11. The vehicle of claim 10, further comprising:

a cold fluid tank in thermal communication with the cooling device; and a radiator in fluid communication with at least one of the first Stirling engine and the cold fluid tank.

12. The vehicle of claim 10, further comprising:

a radiator;

a fluid line configured to route fluid between the radiator and the internal combustion engine;

a heat transfer fluid valve positioned along the fluid line;

a temperature sensor positioned along the fluid line; and an electronic control unit in electronic communication with the temperature sensor, and configured to receive temperature information of the fluid from the temperature sensor, the electronic control unit configured to control the heat transfer fluid valve to open the valve and communicate fluid from the fluid line to the heat loop to be used as the heat transfer fluid when a temperature information equal to, or past, a threshold temperature is communicated from the temperature sensor to the electronic control unit.

13. The vehicle of claim 10, further comprising:

a radiator;

a cold fluid tank in thermal communication with the cooling device and the intake manifold to cool the compressed air; and a return line in fluid communication with the radiator and at least one of the cooling device, the cold fluid line, and the intake manifold, to return fluid to the radiator.

14. The vehicle of claim 10, further comprising:

an electrical system configured to operate at least one of the compressor and the cooling device at a startup phase of the internal combustion engine at least prior to operation of the first Stirling engine.

15. The vehicle of claim 10, further comprising:

a propulsion propeller configured and mounted at a position on the vehicle to generate a propulsion force aiding acceleration of the vehicle when operated; and another Stirling engine in thermal communication with the line heated heat transfer fluid in the heat loop, and operatively coupled to the propulsion propeller to operate the propulsion propeller.

16. The vehicle of claim 10, further comprising:

a further Stirling engine in thermal communication with the heated heat transfer fluid in the heat loop; and an energy propeller operatively coupled to the further Stirling engine to operate the further Stirling engine when activated, the further Stirling engine further increasing the temperature of the heat transfer fluid when operated.

17. The vehicle of claim 16, further comprising:

a cold fluid tank in thermal communication with the cooling device, and configured to be in thermal communication with at least one of a cold sink of the first Stirling engine and a cold sink of the further Stirling engine.

18. The vehicle of claim 16, further comprising:

a gate member configured to transform between an open state and a closed state, wherein the energy propeller is configured to be activated when exposed to ram air, the gate member allowing ram air to reach the energy propeller when in the open state and preventing ram air from reaching the energy propeller when in the closed state.

19. The vehicle of claim 10 wherein the heat transfer fluid in the heat loop is in thermal communication with at least a portion of the internal combustion engine.

20. The vehicle of claim 19 wherein the heat transfer fluid in the heat loop is in thermal communication with at least one of an exhaust system and a catalytic converter.

21. The vehicle of claim 10, further comprising:

a solar collector configured to provide heat to the heat transfer fluid in the heat loop.

* * * * *

UNITED STATES PATENT AND TRADEMARK OFFICE

CERTIFICATE OF CORRECTION

PATENT NO. : 7,891,186 B1
APPLICATION NO. : 12/685997
DATED : February 22, 2011
INVENTOR(S) : Indru J. Primlani It is certified that error appears in the above-identified patent and that said Letters Patent is hereby corrected as shown below:

Column 14, Line 23:
"line heated heat transfer fluid in the heat loop, and" should read, --heated heat transfer fluid in the heat loop, and--.

Signed and Sealed this
Fourth Day of October, 2011

David J. Kappos
*Director of the United States Patent and Trademark Office*